US008061346B2

(12) United States Patent
Tseng

(10) Patent No.: US 8,061,346 B2
(45) Date of Patent: Nov. 22, 2011

(54) BRICK CUTTER

(75) Inventor: Cheng-Hui Tseng, Taichung (TW)

(73) Assignee: Kun-Meng Lin, Huatan Shiang, Changhua County (TW)

( * ) Notice: Subject to any disclaimer, the term of this patent is extended or adjusted under 35 U.S.C. 154(b) by 330 days.

(21) Appl. No.: 12/381,479

(22) Filed: Mar. 11, 2009

(65) Prior Publication Data

US 2010/0229846 A1 Sep. 16, 2010

(51) Int. Cl.
*B28D 1/32* (2006.01)

(52) U.S. Cl. ..... 125/23.01; 125/40

(58) Field of Classification Search ..... 125/23.01, 125/40

See application file for complete search history.

(56) References Cited

U.S. PATENT DOCUMENTS

| | | | | | |
|---|---|---|---|---|---|
| 254,415 | A * | 2/1882 | Wellington | ..... | 125/23.01 |
| 1,734,934 | A * | 11/1929 | Wineman | ..... | 125/23.01 |
| 2,090,471 | A * | 8/1937 | Coffey | ..... | 125/23.01 |
| 2,436,686 | A * | 2/1948 | Coffey | ..... | 125/40 |
| 2,772,671 | A * | 12/1956 | Nowak et al. | ..... | 125/23.01 |
| 4,084,569 | A * | 4/1978 | Chrismas | ..... | 125/23.01 |
| 7,077,121 | B1 * | 7/2006 | Havill | ..... | 125/23.01 |

* cited by examiner

*Primary Examiner* — Maurina Rachuba
(74) *Attorney, Agent, or Firm* — Charles E. Baxley

(57) ABSTRACT

A brick cutter includes a base, a swing arm that has a handle portion, wherein the handle portion has one end pivotally connected to the base and an opposite end formed with a head so that the swing arm is capable of swinging relative to the base, and a chisel that has a cutting portion and a rod portion, wherein the rod portion is coupled with the head of the swing arm. Thereby, when a user holds the swing arm with one hand, and hammers the chisel with a hamper held in the other hand, the hammered chisel impacts a brick so as to cut the brick.

16 Claims, 8 Drawing Sheets

BRICK CUTTER

BACKGROUND OF THE INVENTION

1. Technical Field

The present invention relates to brick cutters, and more particularly, to a brick cutter that allows convenient and effort-saving operation.

2. Description of Related Art

Diverse modern buildings require bricks in various shapes other than the plain cuboids. Especially, bricks may need to be cut and chamfered for forming a quoin of a house. Thus, it is common to see at a construction site that a building worker has his one hand holding a hammer and the other hand holding a chisel to cut bricks into desired sizes or shapes.

However, the conventional approach to cutting bricks is nevertheless defective because uniformizing the angles the hammer hits on the chisel and the chisel cuts the bricks is impossible. Besides, when operating with the traditional chisel and hammer, the building worker's hand holding the chisel tends to be accidentally hurt by the dropping hammer. Furthermore, for different needs in construction, brinks diverse in material, hardness and size may be used and the traditional chisel and hammer are obviously not a universal solution for all these bricks. Though marble cutters are therefore conventionally used for cutting bricks of large hardness and size, such marble cutters are usually bulky and inconvenient to transport and operate.

SUMMARY OF THE INVENTION

The primary objective of the present invention is to provide a brick cutter that is advantaged by providing operational safety and adaptability to a wide range of bricks.

The disclosed brick cutter comprises a base, a swing arm that has a handle portion, wherein the handle portion has one end pivotally connected to the base and an opposite end formed with a head, and a chisel that has a cutting portion and a rod portion, wherein the rod potion pierces through the head of the swing arm. Thereby, when a user holds the swing arm with one hand, and hammers the chisel with a hamper held in the other hand, the hammered chisel rams and in turn break the brick safely.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawings, wherein.

DETAILED DESCRIPTION OF THE PREFERRED EMBODIMENT

Figure 1:
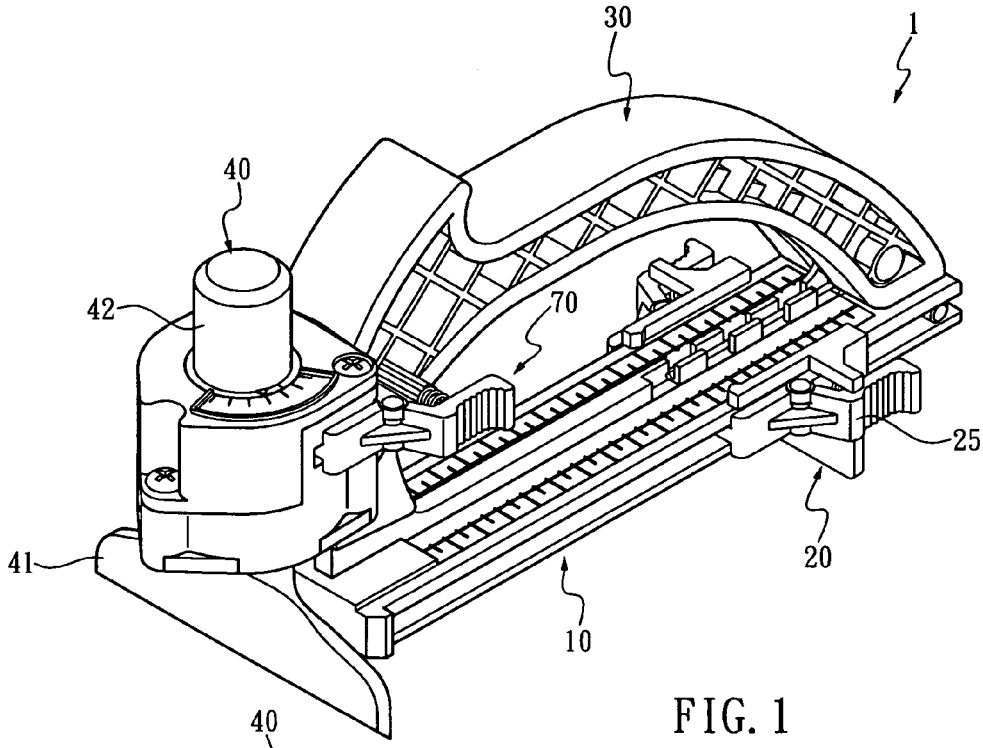
FIG. 1 is an oblique front elevation of a brick cutter according to the present invention.
Figure 2:
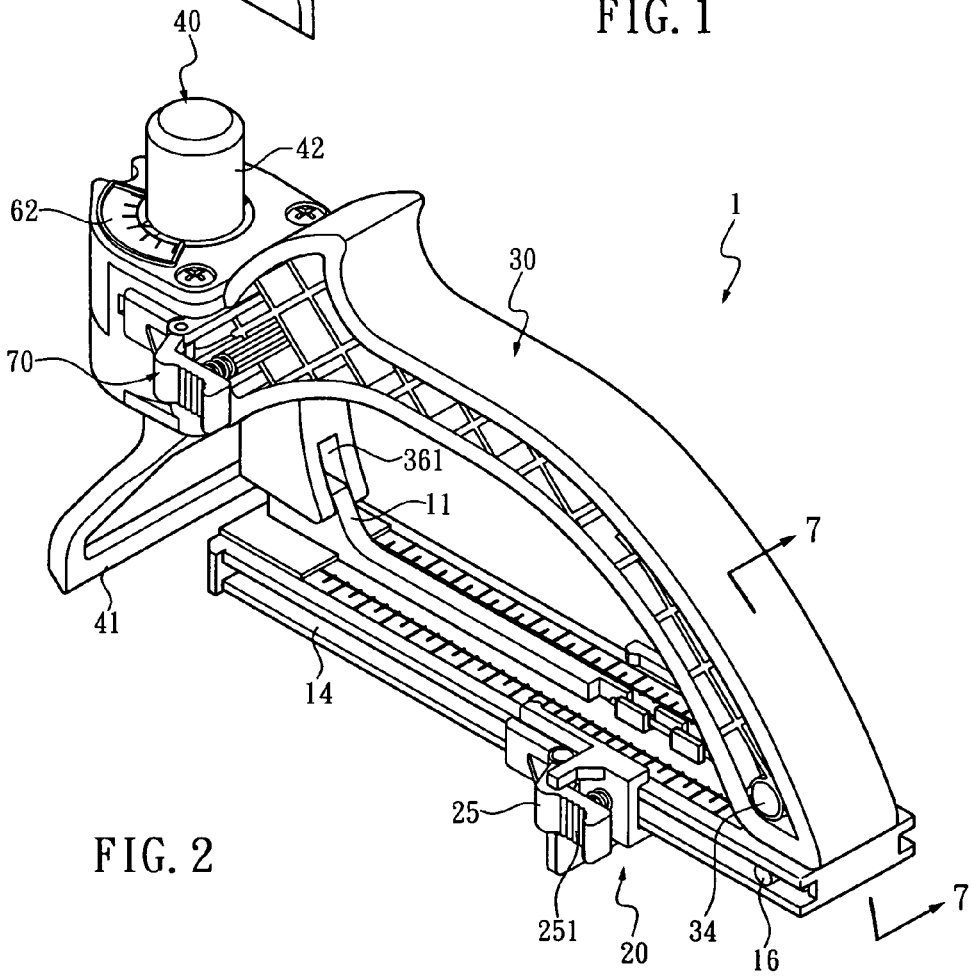
FIG. 2 is an oblique back elevation of the brick cutter.

Referring to FIGS. 1 and 2, a brick cutter 1 comprises a base 10, a sliding fixer 20, a swing arm 30 and a chisel 40. The sliding fixer 20 is slidably mounted on the base 10. The swing arm 30 has one end pivotally connected to the base 10. The chisel 40 is coupled with an opposite end of the swing arm 30.

Figure 3:
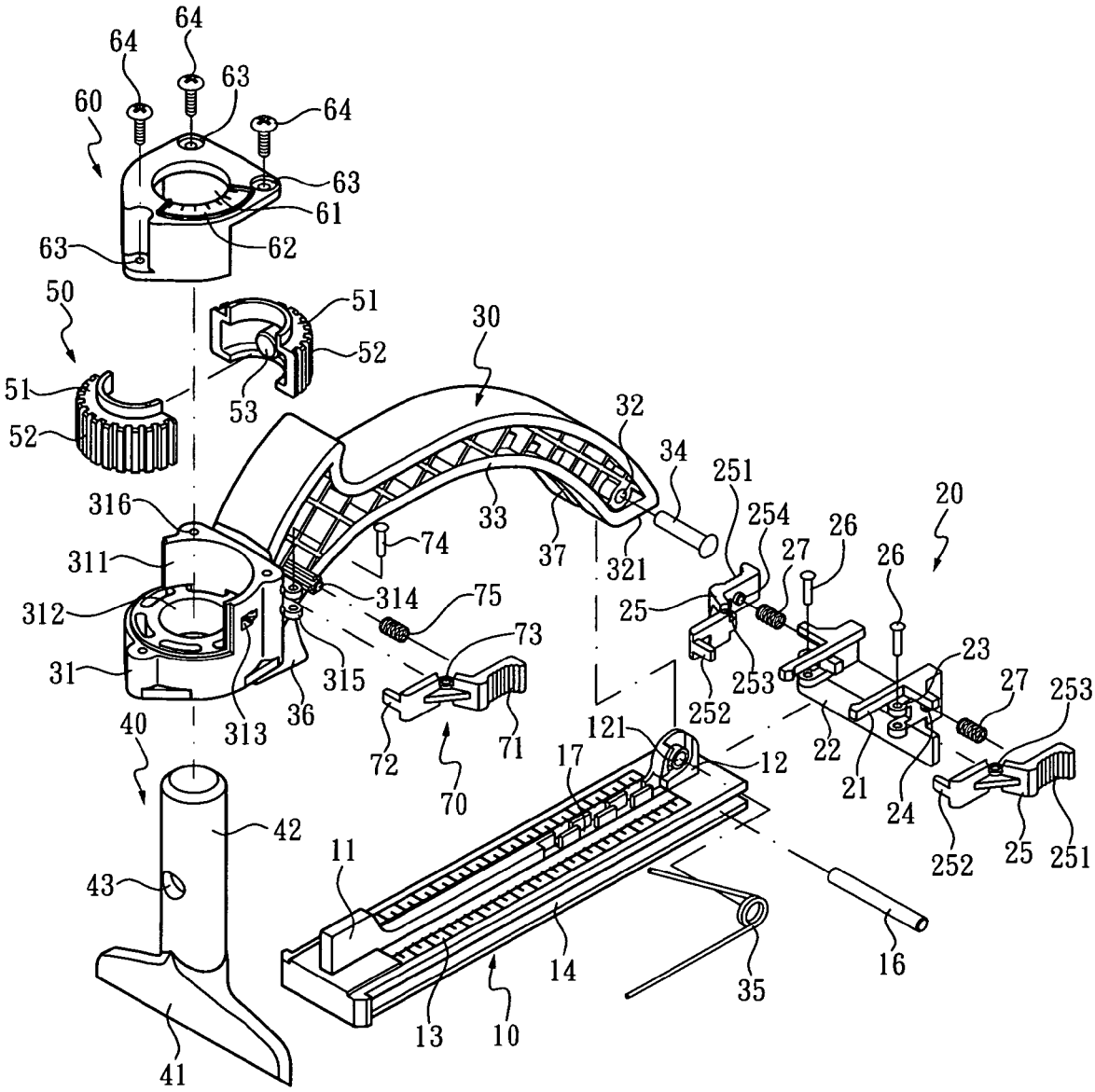
FIG. 3 is an exploded view of the brick cutter.

Referring to FIG. 3, the base 10 being a plank made of an impact-resistant material has one end provided with a bulge 11 and an opposite end formed with a joint portion 12 that has a pivot hole 121. A scaled portion 13 is deposited between the two ends of the base. A pair of rails lengthwise extends on the base 10. Each said rail has one open end and one closed end. A spring recess 17 also lengthwise extends on the base 10.

The sliding fixer 20 is U-shaped and has a pair of guiding portions 21 at two sides for positioning the sliding fixer 20 on the rails 14 of the base 10. The sliding fixer 20 has a downward extending retaining plate 22 for abutting against a lateral of a workpiece to be cut. Each said guiding portion 21 is accompanied by a pivot trunnion 23 and a positioning protrusion 24.

The swing arm 30 also made of an impact-resistant material has a head 31 and a pivot hole 32 positioned opposite to the head 31. An arched handle portion 33 is provided between the head 31 and the pivot hole 32. the swing arm 30 and the joint portion 12 of the base 10 are pivotally combined at pivot hole 32 through a rivet 34 and a torsion spring 35. A receiving portion 36 downward extends from the head 31 of the swing arm 30. An opening 312 vertically passes through the head 31 of the swing arm 30 and is partially enclosed by a parapet 311. A slot 313, a column 314, and a pivot trunnion 315 are formed at one side of the parapet 311.

The chisel 40 has a cutting portion 41 and a rod portion 42. A pair of positioning recesses 43 is formed at opposite sides of the rod portion 42. The opening 312 allows the rod portion 42 of the chisel 40 to pass therethrough.

An angle adjuster 50 made of an impact-resistant material is rotatably set inside the parapet 311 of the head 31. The angle adjuster 50 is composed of a pair of semicircular members 51. Each said semicircular member 51 has a toothed portion 52 formed at an outer periphery thereof and a combining pin 53 transversely extended from an inner periphery thereof. Thereby, the angle adjuster 50 and the chisel 40 can be combined by inserting the combining pins 53 of the semicircular members 51 into the positioning recesses 43 of the chisel 40.

A cap 60 has a through hole 61 and an angle indicator 62 settled beside the through hole 61. A plurality of fastening holes 63 deposited around the through hole 61 for allowing a plurality of screws to pass therethrough and then get coupled with threaded holes 361 provided on the parapet 311 so that the cap 60 can be fastened to the head 31 of the swing arm 31 and the angle adjuster 50 is rotatably positioned under the cap 60. Therein, the through hole 61 partially exposes the rod portion 42 of the chisel 40.

A first positioning member 70 is disposed at the head 31 of the swing arm 30 for retaining the angle adjuster 50 from rotating relative to the head 31. The first positioning member 70 comprises a pressing portion 71, a retaining tongue 702, and a through hole 73 provided therebetween. The through hole 73 receives a pivot pin 74 that pivotally connects the first positioning member 70 and the pivot trunnion 315 of the head 31. Besides, a spring 75 is arranged between the pressing portion 71 and the column 314.

A pair of second positioning members 25 flank the sliding fixer 20 and each said second positioning member 25 is structurally identical to the first positioning member 70. The second positioning member 25 has one end formed as a pressing portion 251 and an opposite end formed with a retaining tongue 252. A through hole 253 is provided at a middle part of the second positioning member 25 so as to allow a pivot pin 26 to pivotally connect the second positioning member 25 and the pivot trunnion 23 of the sliding fixer 20. Besides, a positioning protrusion 254 is formed at a rear side of the pressing portion 251 and a spring 27 is positioned between the positioning protrusions 24 and 254.

Figure 4:
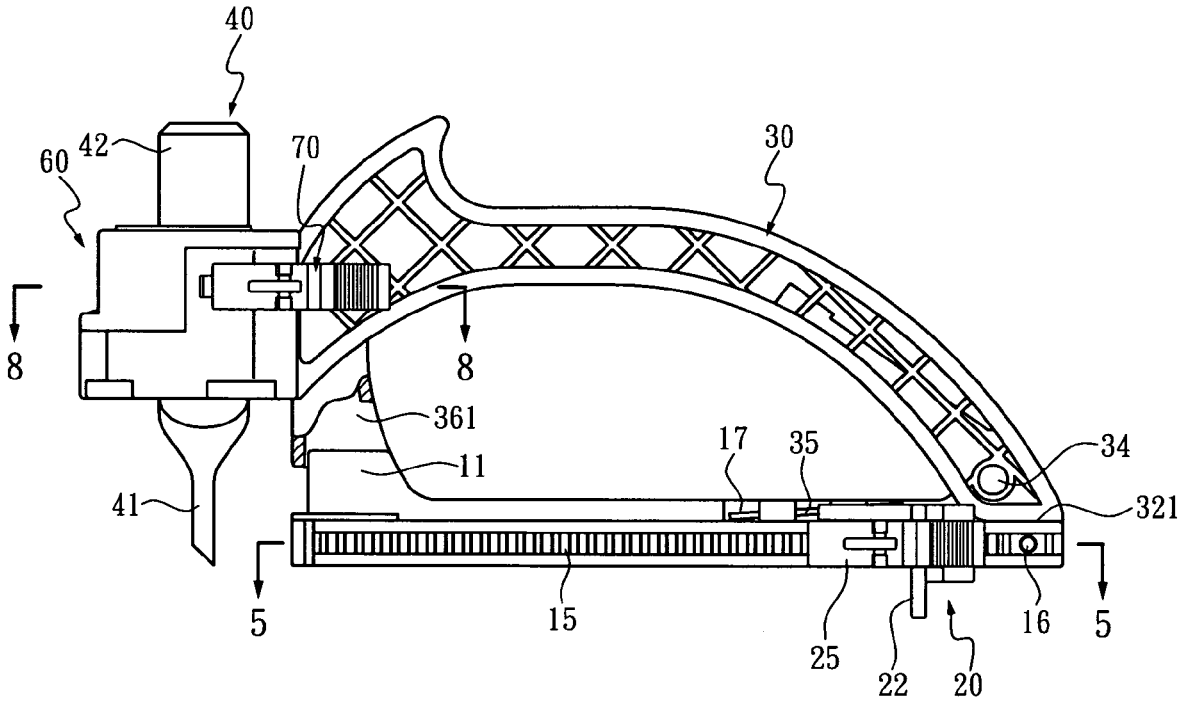
FIG. 4 is a side sectional view of the brick cutter.

In FIGS. 2 and 4, a dent 361 is formed at a bottom of the receiving portion 36 for positionally corresponding to the bulge 11 of the base 10. Normally, the bulge 11 is partially received in the dent 361 so that when the chisel 40 rams downward under an external force, the swing arm 30 pivotally swings toward the base 10. At this time, the entire bulge 11 is accommodated in the dent 361 and the swing arm 30 is retained from moving transversely.

Figure 5:
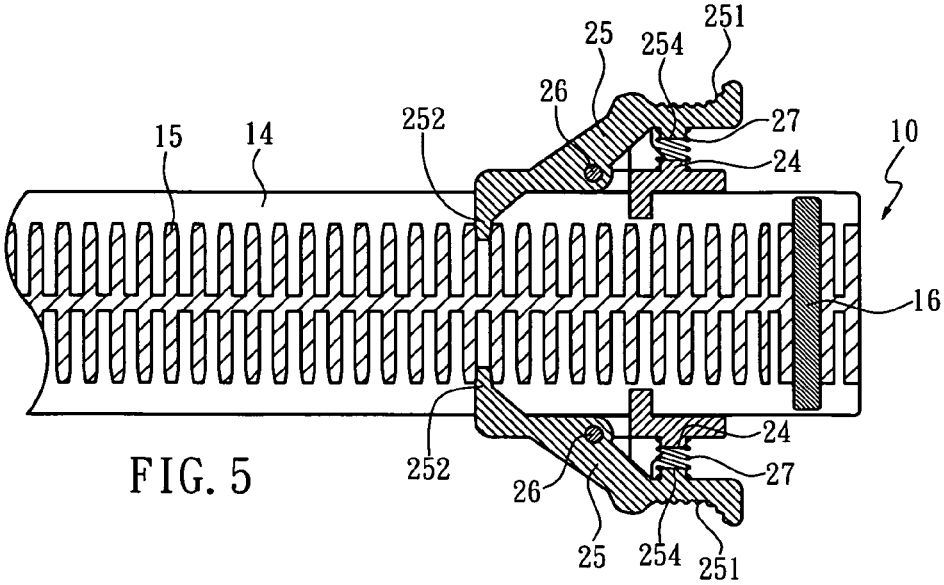
FIG. 5 is a cross-sectional view of the brick cutter taken along Line 5-5 of FIG. 4.

Referring to FIG. 5, teeth 15 are provided in each said rail 14. When the sliding fixer 20 is in its fixing position, the pressing portions 251 of the second positioning members 14 are pushed away from the sliding fixer 20 by resilience of the springs 27 so that the retaining tongues 252 get engaged with the corresponding teeth 15 of the rails 14. A fastening pin 16 is provided at the base 10 adjacent to the open ends of the rails 14 for retaining the sliding fixer 20 from leaving the base 10.

Figure 6:
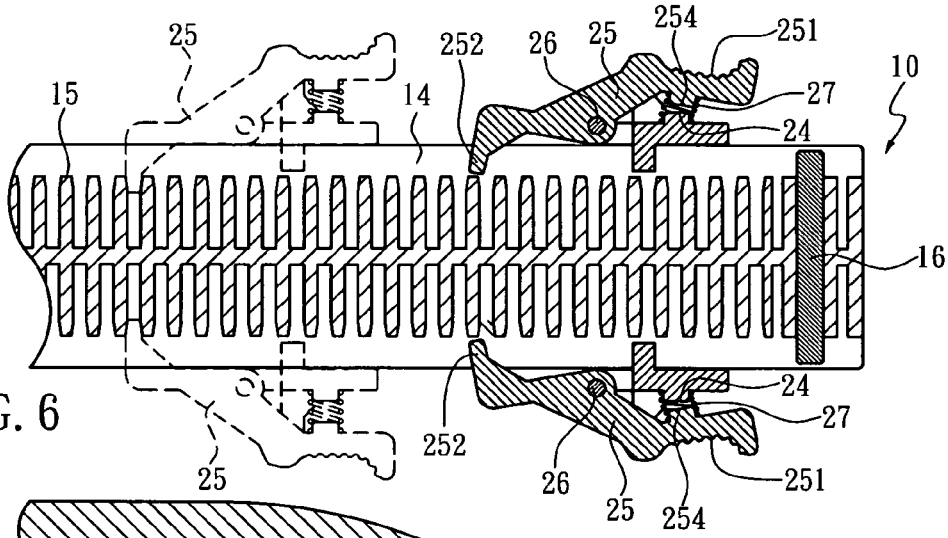
FIG. 6 is a schematic drawing showing movement of a sliding fixer of the brick cutter.

As can be seen in FIG. 6, when the pressing portions 251 of the second positioning members 25 are pressed inward, the second positioning members 25 pivot against the pivot pins 26 relative to the sliding fixer 20. Consequently, the retaining tongues 252 depart from the teeth 15 and thus the sliding fixer 20 is allowed to freely slide along the base 10. When the pressing portions 251 of the second positioning members 25 are released, the second positioning members 25 get coupled with different said teeth 15 so as to fix the sliding fixer 20 at a different position on the base 10.

Figure 7:
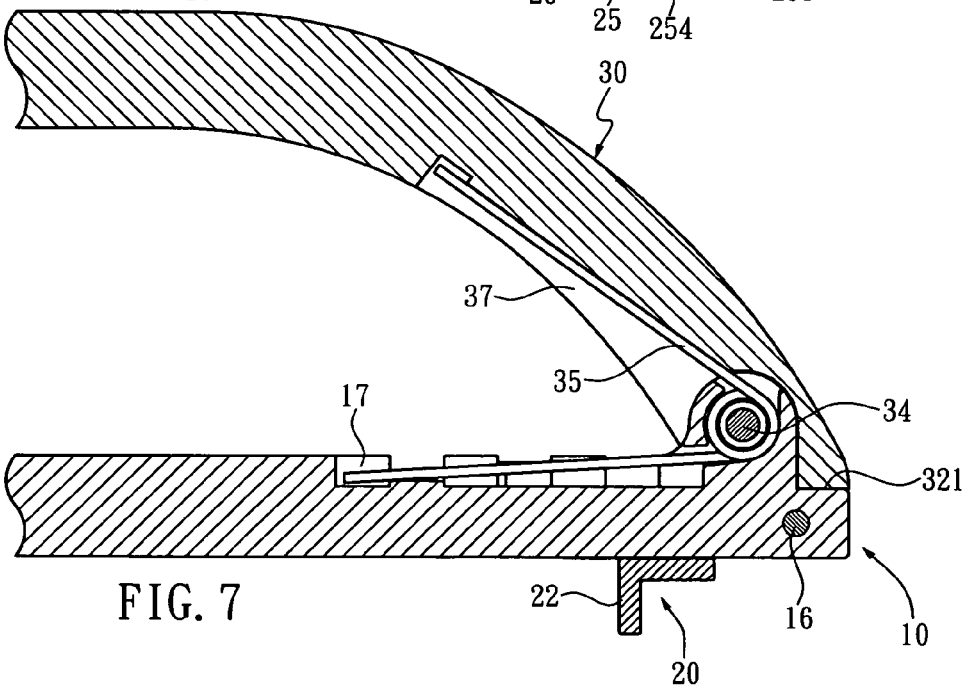
FIG. 7 is another cross-sectional view of the brick cutter taken along Line 7-7 of FIG. 2.

Referring to FIG. 7, a spring recess 37 is formed at the pivot end of the swing arm 30 for accommodating one end of the torsion spring 35 while an opposite end of the torsion spring 35 is received in the spring recess 17 of the base 10. Thereby, normally, the swing arm 30 and the base 10 are pushed apart by the strain of the torsion spring 35 while an end 321 of the swing arm 30 abuts against the base 10 to limit an angle where the swing arm 30 and the base 10 are pushed apart. When the torsion spring 35 is compressed, the swing arm 30 is drawn and swings toward the base 10.

Figure 8:
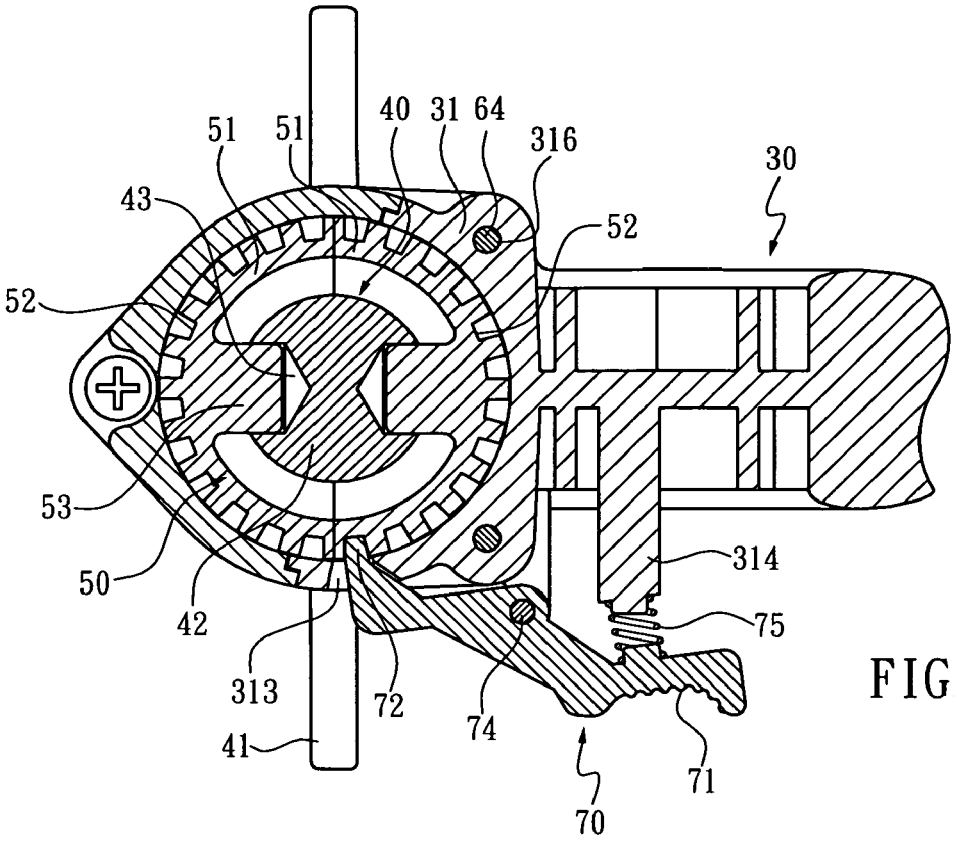
FIG. 8 is another cross-sectional view of the brick cutter taken along Line 8-8 of FIG. 4.

According to FIG. 8, the first positioning member 70 is pivotally connected to the head 31. Normally, the retaining tongue 75 of the first positioning member 70 passes through the slot 313 and gets engaged with the teeth 52 of the semicircular members 51 so that the angle adjuster 50 is retained from rotating relative to the head 31.

Figure 9:
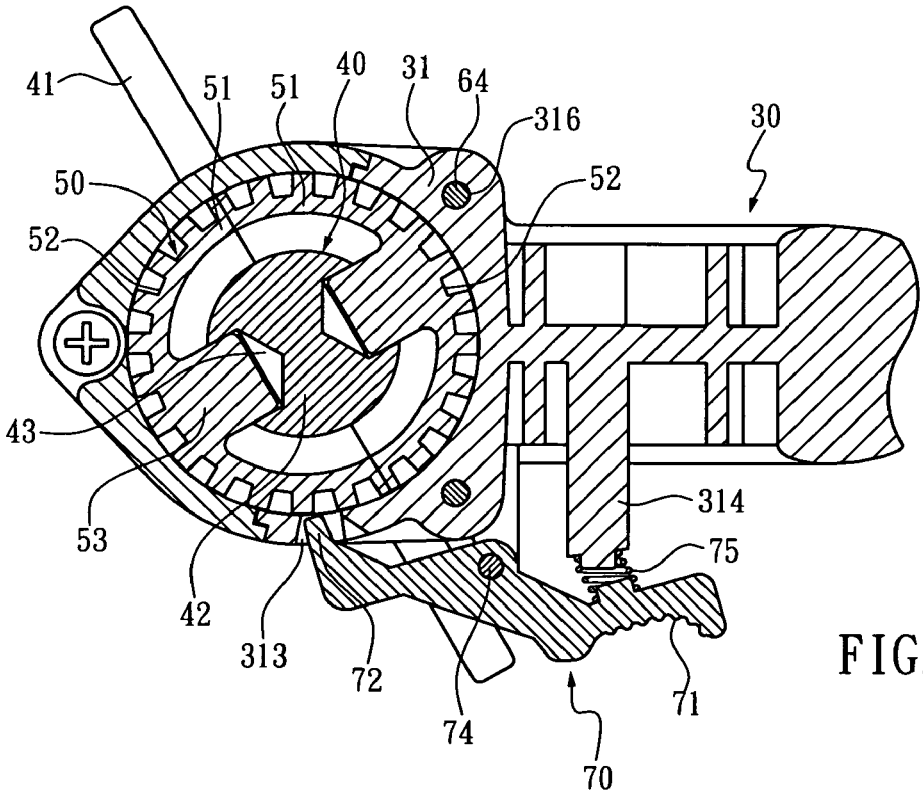
FIG. 9 is a schematic drawing showing a chisel of the brick cutter rotated.

In FIG. 9, when the pressing portion 71 of the first positioning member 70 is pressed, the retaining tongue 72 departs from the teeth 52 so that the chisel 40 is allowed to rotate with respective to the head 31, thereby changing angle between the cutting portion 41 and the swing arm 30. When the pressing portion 71 is released from being pressed, the first positioning member 70 can engage with different said teeth 52 and thus retain the chisel 40 from rotating again.

Figure 10:
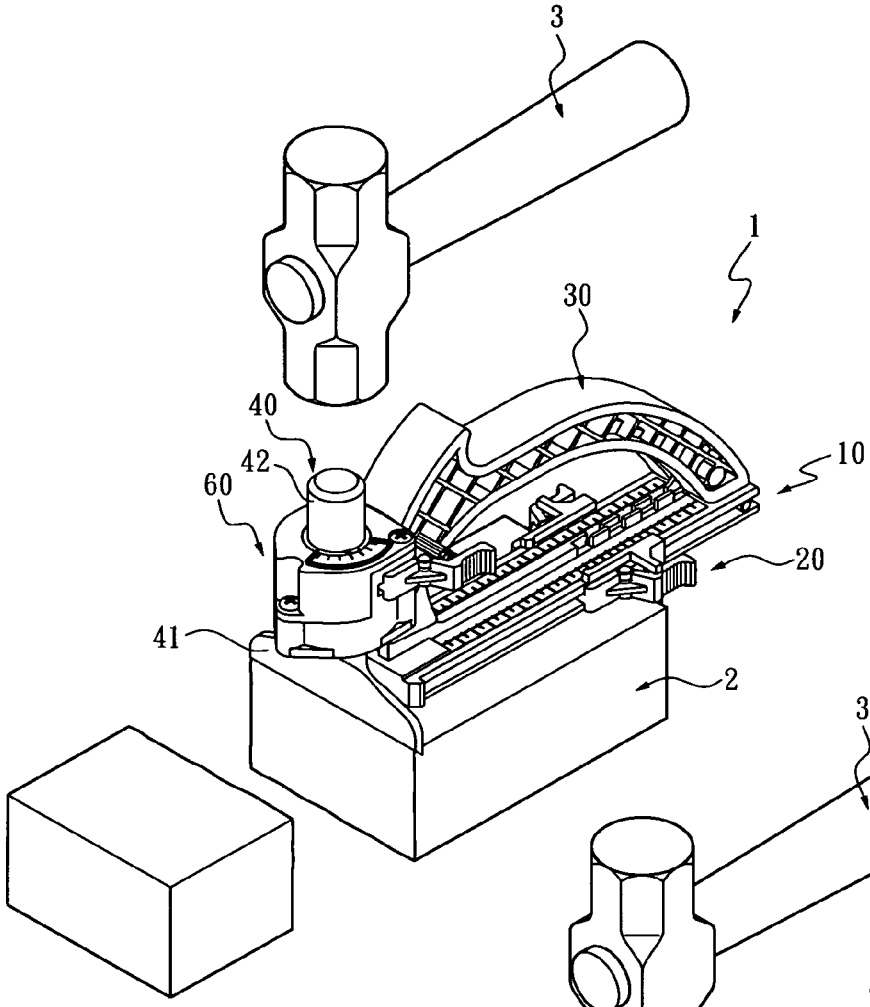
FIG. 10 is an applied view of the brick cutter.

In FIG. 10, the brick cutter 1 is such placed on a brick 2 that the retaining plate 22 of the sliding fixer 20 abuts on a lateral of the brick 2. At this time, a user can hole the handle portion 33 of the swing arm 30 with one hand and hold a hammer 3 to hammer the chisel 40 so that the chisel 40 receives a ramming force from the hammer 3 and in turn ram the brick 2 to break the brick 2. Since the handle portion 33 allows the user's hand to keep away from the chisel 40 where the hamper hits, the risk of accidentally hurting the hand can be eliminated. Consequently, the brick 2 can be cut into desired size conveniently and safely. On the other hand, when the chisel 40 receives and passes the ramming force downward, the swing arm 30 also swings toward the base 10 under the ramming force. Thus, the downward swinging movement of the swing arm 30 reinforces the ramming force of the chisel 40 so as to allow a laborsaving operation of brick cutting.

Figure 11:
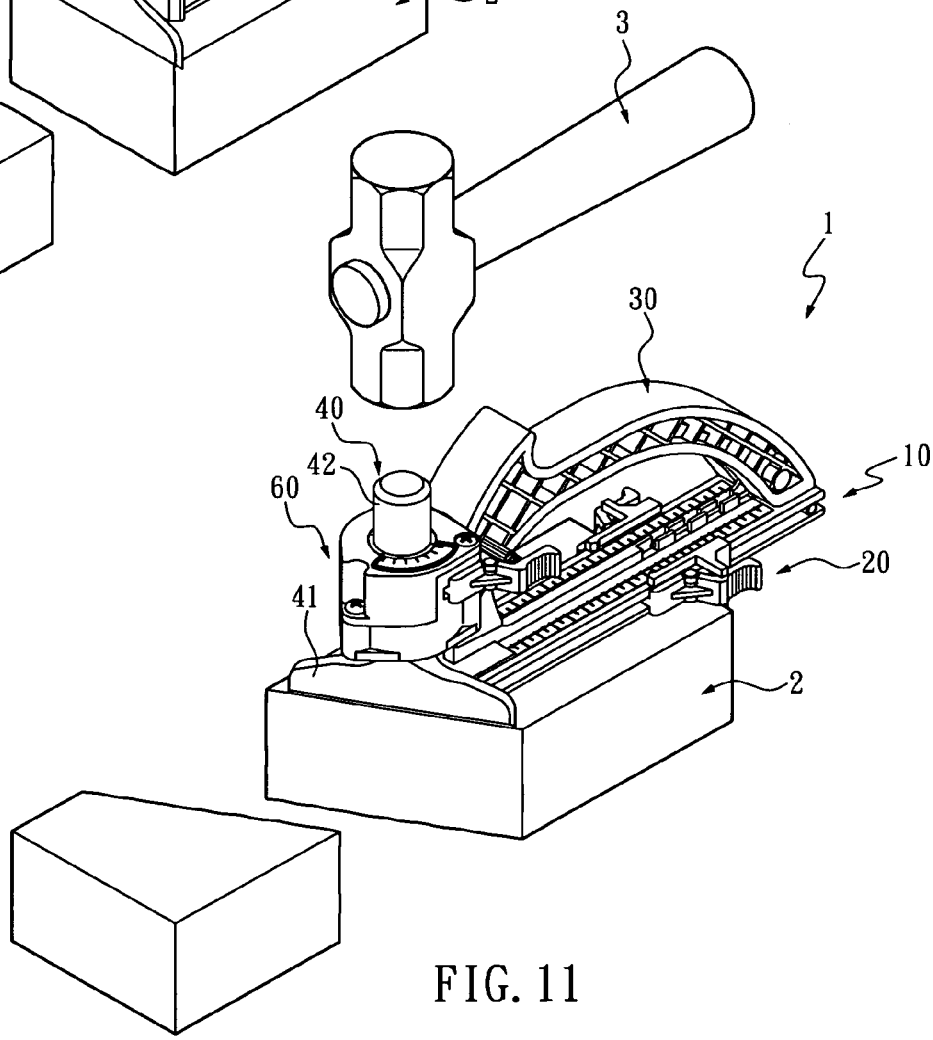
FIG. 11 is another applied view of the brick cutter.

In FIG. 11, by using the first positioning member 70, the angle between the chisel 40 and the swing arm 30 is changed from a vertical as shown in FIG. 10 so that the brick cutter 1 can cut a brick into non-square shaped pieces, thereby improving the practicability of the brick cutter 1.

Figure 12:
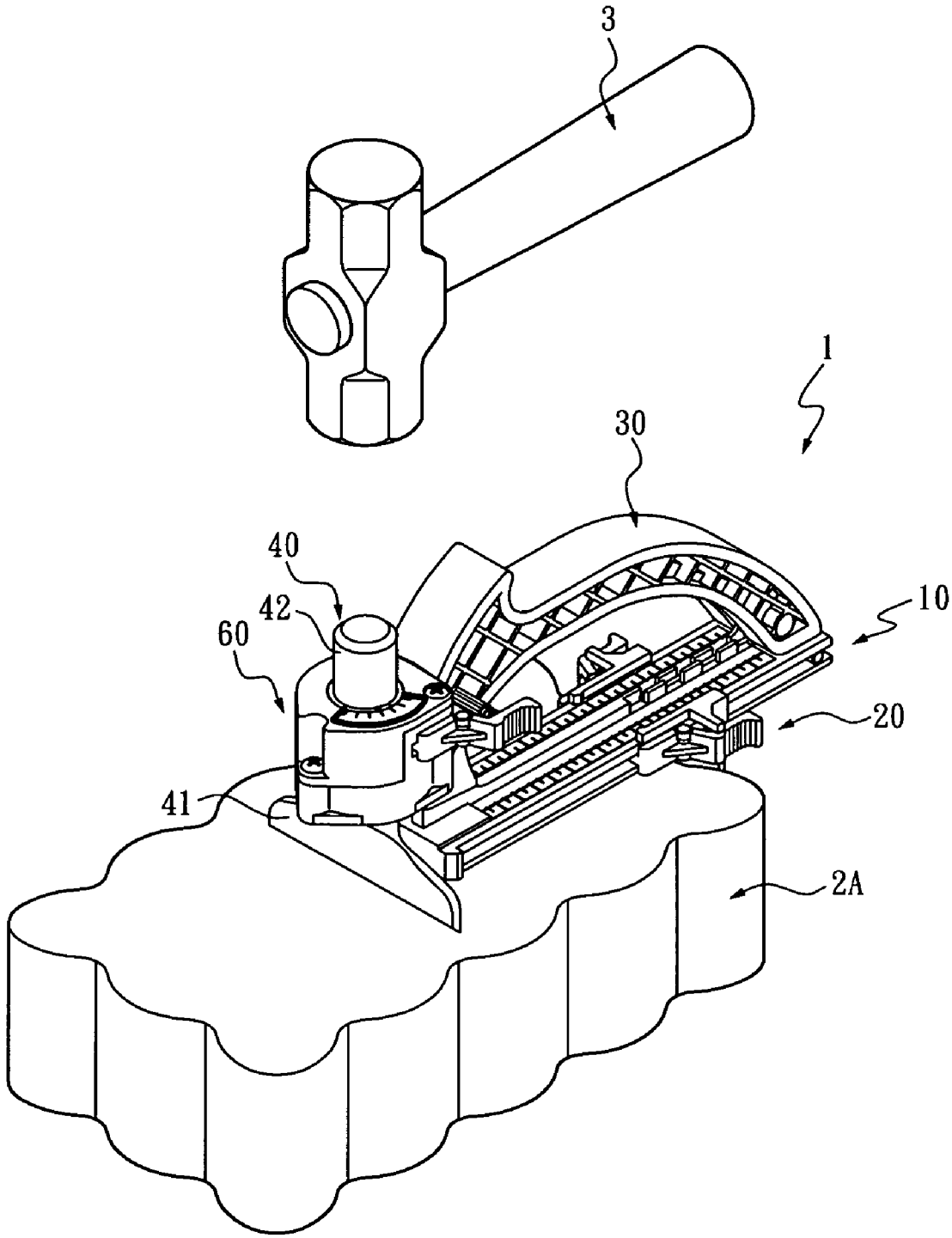
FIG. 12 is still another applied view of the brick cutter.
Figure 13:
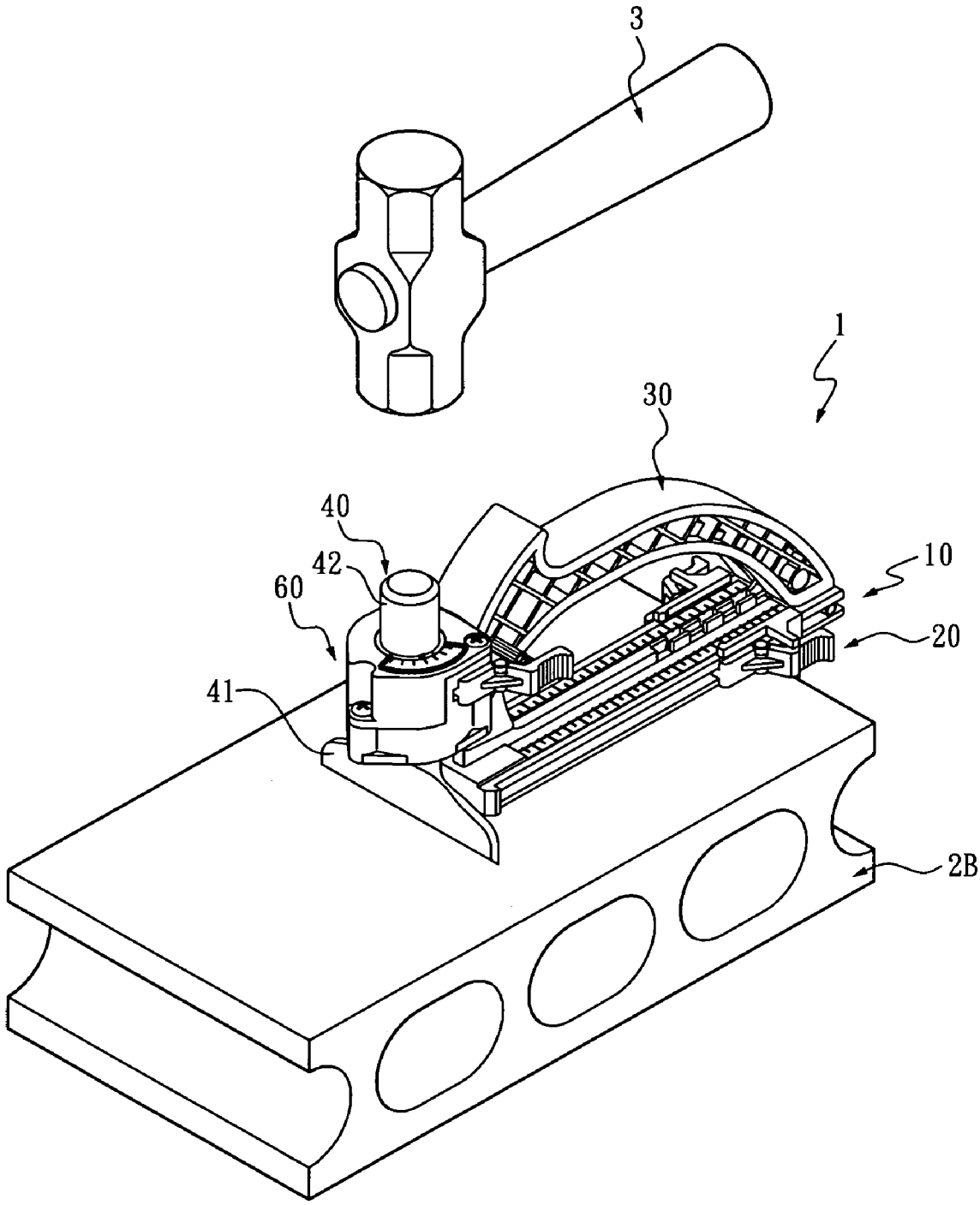
FIG. 13 is yet another applied view of the brick cutter.

As can be seen in FIGS. 12 and 13, the brick cutter 1 may be implemented to cut solid or hollow bricks with the sliding fixer 20 properly settled by using the second positioning members 25 to fit the brick cutter 1 to bricks with different lengths.

The present invention has been described with reference to the preferred embodiment and it is understood that the embodiment is not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A brick cutter, comprising:

a base;

a swing arm, having a handle portion with one end pivotally connected to the base and an opposite end formed with a head, wherein the swing arm is capable of swinging relative to the base; and a chisel, having a cutting portion and a rod portion, wherein the rod portion is coupled with the head of the swing arm, wherein a torsion spring is provided between the swing arm and the base so that when the torsion spring is in a normal position, the swing arm and the base are pushed apart while an end of the swing arm abuts against the base to limit an angle between the swing arm and the base, and when the torsion spring is in a compressed position, the swing arm is drawn toward the base.

2. A brick cutter, comprising:

a base;

a swing arm, having a handle portion with one end pivotally connected to the base and an opposite end formed with a head, wherein the swing arm is capable of swinging relative to the base; and a chisel, having a cutting portion and a rod portion, wherein the rod portion is coupled with the head of the swing arm, wherein a torsion spring is provided between the swing arm and the base so that when the torsion spring is in a normal position, the swing arm and the base are pushed apart while an end of the swing arm abuts against the base to limit an angle between the swing arm and the base, and when the torsion spring is in a compressed position, the swing arm is drawn toward the base and wherein a through hole passing through the head allows the rod portion of the chisel to pass therethrough and then get coupled with the head of the swing arm.

3. The brick cutter of claim 1 wherein a receiving portion is provided at a side of the head of the swing arm and the receiving portion has a dent while a bulge is formed at a side of the base for being received in the dent.

4. The brick cutter of claim 1 wherein a sliding fixer is slidably mounted on the base lengthwise, the sliding fixer being U-shaped and having a pair of guiding portions at two each sides thereof so that the sliding fixer is slidably assembled to at least a rail lengthwise extended on the base.

5. The brick cutter of claim 4, wherein a retaining plate is provided extended downward from the sliding fixer for abutting against a lateral of a workpiece.

6. The brick cutter of claim 4, wherein at least a second positioning member is attached to the sliding fixer for detachably coupling the sliding fixer with the base.

7. The brick cutter of claim 6, wherein the rail has teeth and the second positioning member has one end formed with a retaining tongue for being coupled with the teeth of the rail and an opposite end formed with a pressing portion.

8. The brick cutter of claim 7, wherein a spring is provided between the pressing portion of the second position member and the sliding fixer.

9. The brick cutter of claim 4, wherein a fastening pin is provided at the base for retaining the sliding fixer from leaving the base.

10. The brick cutter of claim 1 wherein a scaled portion is deposited lengthwise on the base.

11. The brick cutter of claim 2 wherein an angle adjuster is fixedly coupled to the rod portion of the chisel and is rotatably assembled to the head of the swing arm.

12. The brick cutter of claim 11, wherein a cap is mounted on the head of the swing arm so as to such retain the angle adjuster that the angle adjuster is only allowed to rotate relative the head, the cap having a through hole that allows the rod potion of the chisel to pass therethrough.

13. The brick cutter of claim 11 wherein the rod potion of the chisel is formed with positioning recesses at two opposite sides thereof while the angle adjuster is a pair of semicircular members facing each other, each semicircular member having a combining pin transversely extended from an inner periphery thereof for being inserted to a corresponding said positioning recess.

14. The brick cutter of claim 11 wherein an outer periphery of the angle adjuster has a toothed portion while a first positioning member pivotally connected to the head has one end formed with a retaining tongue for passing through a slot formed at the head to engage with the toothed portion and an opposite end formed with a pressing portion.

15. The brick cutter of claim 14 wherein a spring is provided between the pressing portion and the head.

16. The brick cutter of claim 11, wherein an angle indicator is settled on the cap.

* * * * *